US009371116B2

(12) United States Patent
Drouet et al.

(10) Patent No.: US 9,371,116 B2
(45) Date of Patent: Jun. 21, 2016

(54) METHOD FOR PREDICTING AT LEAST ONE MOVEMENT OF A SHIP UNDER THE EFFECT OF THE WAVES

(71) Applicant: SOCIETE D'INGENIERIE DE RECHERCHES ET D'ETUDES EN HYDRODYNAMIQUE NAVALE PAR ABREVIATION SIREHNA, Nantes (FR)

(72) Inventors: Celine Drouet, Casson (FR); Nicolas Cellier, Nantes (FR)

(73) Assignee: SOCIETE D'INGENIERIE DE RECHERCHES ET D'ETUDES EN HYDRODYNAMIQUE NAVALE PAR ABREVIATION SIREHNA, Nantes (FR)

( * ) Notice: Subject to any disclaimer, the term of this patent is extended or adjusted under 35 U.S.C. 154(b) by 0 days.

(21) Appl. No.: 14/400,784

(22) PCT Filed: May 14, 2013

(86) PCT No.: PCT/EP2013/059871
§ 371 (c)(1),
(2) Date: Nov. 12, 2014

(87) PCT Pub. No.: WO2013/171179
PCT Pub. Date: Nov. 21, 2013

(65) Prior Publication Data

US 2015/0183497 A1 Jul. 2, 2015

(30) Foreign Application Priority Data

May 16, 2012 (FR) ..... 12 54503

(51) Int. Cl.
*B60L 3/00* (2006.01)
*G08G 1/02* (2006.01)
*B63B 39/00* (2006.01)

(52) U.S. Cl.
CPC ..... *B63B 39/00* (2013.01)

(58) Field of Classification Search
USPC ..... 701/21; 340/984
See application file for complete search history.

(56) References Cited

U.S. PATENT DOCUMENTS 3,665,168 A * 5/1972 Canfield ..... G06F 17/17 114/122
6,469,664 B1 * 10/2002 Michaelson ..... B63B 43/18 342/357.31

(Continued)

FOREIGN PATENT DOCUMENTS

JP 2004338580 A * 12/2004

*Primary Examiner* — Thomas G Black
*Assistant Examiner* — Tyler Paige
(74) *Attorney, Agent, or Firm* — Knobbe Martens Olson and Bear, LLP

(57) ABSTRACT

The method consists of: A step of estimating a direction (D) of propagation of the swell and a propagation speed of the swell, a step of measuring the development of a characteristic value of the swell at at least one measuring point (P) upstream of the ship in the direction of propagation (D) by periodically measuring the value, a step of detecting a lull in the swell at the measuring point (P) using a measurement of the development of the characteristic value, including a measurement of a duration of a lull detected, and if a lull in the swell is detected at the measuring point (P): a step of calculating a time interval between the detection of the lull in the swell at the detected measurement point (P) and a moment in which the lull affects the movement of the ship (N), carried out, in particular, depending on the estimated speed of propagation of the swell.

10 Claims, 1 Drawing Sheet

(56) References Cited

U.S. PATENT DOCUMENTS 7,359,799 B2 * 4/2008 Bresch ..... G01W 1/10 702/1
8,643,509 B1 * 2/2014 Chen ..... B63B 9/08 114/74 R
2004/0024503 A1 * 2/2004 Swinbanks ..... B63B 17/0081 701/36
2005/0278094 A1 * 12/2005 Swinbanks ..... B63B 17/0081 701/37
2007/0019505 A1 * 1/2007 Lohrmann ..... G01C 13/002 367/25
2008/0239869 A1 * 10/2008 Lohrmann ..... G01C 13/002 367/3
2009/0085574 A1 * 4/2009 Pan ..... G01R 31/025 324/509
2012/0253566 A1 * 10/2012 Ballou ..... G08G 3/02 701/21
2012/0303293 A1 * 11/2012 McNeill ..... E21B 17/01 702/34
2013/0035859 A1 * 2/2013 Guatteri ..... G08B 31/00 702/3
2014/0107971 A1 * 4/2014 Engedal ..... B66C 13/02 702/150
2014/0292549 A1 * 10/2014 Liao ..... H03M 7/30 341/87
2015/0183497 A1 * 7/2015 Drouet ..... B63B 39/00 701/21

* cited by examiner

METHOD FOR PREDICTING AT LEAST ONE MOVEMENT OF A SHIP UNDER THE EFFECT OF THE WAVES

CROSS-REFERENCE TO RELATED APPLICATIONS

This application is the U.S. National Phase under 35 U.S.C. §371 of International Application PCT/EP2013/059871, filed May 14, 2013, which claims priority to FR 12 54503, filed May 16, 2012.

FIELD OF THE INVENTION

This invention concerns a method for predicting at least one movement of a ship on an area of water under the effect of a swell on this area of water.

BACKGROUND OF THE INVENTION

In this description 'a movement of a ship' refers to a translative movement along an axis or a rotational movement about an axis. In particular, the movement in question will generally be selected from:

- A translative movement of the ship along a longitudinal axis (also known as 'surge'),
- A translative movement of the ship along a transverse axis (also known as 'sway'),
- A translative movement of the ship along a vertical axis (also known as 'heave'),
- A rotational movement of the ship about the longitudinal axis (also known as 'rolling'),
- A rotational movement of the ship about the transverse axis (also known as 'pitch'),
- A rotational movement of the ship about the vertical axis (also known as 'yaw'), Certain operations carried out by the ship or from the ship, e.g., deployment or recovery of a drone, require the ship to be highly stable. Swells generally cause the ship to execute at least one of the following movements.

In order to safely carry out an operation requiring the ship to be stable, the movements of the ship under the effects of the swell must be predicted in order to anticipate them with suitable movements for the execution of the operation and/or to compensate the movements induced by the swell.

To this end, various methods for predicting at least one movement of a ship under the effect of a swell are already known from the prior art. However, such prior-art methods generally do not allow for the movements of the ship under the effects of the swell to be anticipated sufficiently in advance or sufficiently accurately, or are very complex to implement.

SUMMARY OF THE INVENTION

The invention seeks, in particular, to remedy these disadvantages by providing a relatively simple prediction method that allows for sufficiently exact prediction, sufficiently in advance, of the movements of the ship under the effects of the swell.

To this end, the invention concerns, in particular, a method for predicting at least one movement of a ship on an area of water under the effect of a swell on this area of water, characterised in that it includes:

- a step of estimating a direction of propagation of the swell, and a step of estimating a propagation speed of the swell in the direction of propagation,

- a step of measuring the development of a characteristic value of the swell at at least one measuring point upstream of the ship in the direction of propagation by periodically measuring the value,
- a step of detecting a lull in the swell at the measuring point using a measurement of the development of the characteristic value, including a measurement of a duration of a lull detected, and if a lull in the swell is detected at the measuring point:

- a step of calculating a time interval between the detection of the lull in the swell at the detected measurement point and a moment in which the lull affects the movement of the ship, carried out, in particular, depending on the estimated speed of propagation of the swell.

The invention proposes measuring the swell upstream of the ship, detecting upstream lulls in the swell, and estimating the downstream propagation of the lulls towards the ship in order to predict the times at which the ship is in the way of a lull in the swell.

This principle of the invention is based, in particular, on the fact that, for lull periods of sufficient length, it is possible to disregard the deformation of the envelope of the swell between an upstream measurement point and the downstream position of the ship. Thus, it is possible to consider only a single unique propagation speed of the lull rather than a different speed for each component of the spectrum of the swell.

Such a method is particularly simple to implement because it seeks simply to predict a lull for the movement of the ship, and not to predict the precise behaviour of the movement.

In fact, it appears that, for certain operations requiring the ship to be stable, it is sufficient to know a time at which the movement of the ship is slight (lull) without any need to know the specific behaviour of the ship. Thus, the method according to the invention is sufficiently accurate.

The method according to the invention may further include one or more of the following characteristics, taken alone or in all combinations technically possible:

- Following the measuring step, the method includes a step of filtering the development of the characteristic value measured by means of a discrete filter, the inputs of which are the characteristic measures periodically measured and the outputs of which are an output signal representing the effect of the development of the characteristic value on the movement in question of a notional ship identical to the ship and positioned at the measurement point, and a step of calculating an envelope of the output signal of the filter.
- The step of detecting a lull in the swell at the measurement point comprises: A comparison of the envelope with a predetermined amplitude threshold, and the measurement of the duration of the lull by measuring the duration in which the envelope is below the amplitude threshold, whereby a lull is considered detected when the duration of the lull is greater than a first predetermined duration threshold.
- The step of calculating an envelope includes the application of a Hilbert transformation to the output signal of the filter.
- The Hilbert transformation is carried out on a sliding window applied to the output signal of the filter, whereby the sliding window is chosen to coincide between two 0 passes.
- Following the step of calculating an envelope and before the step of detecting a lull, the method includes a step of breaking down the envelope into wavelets.
- The wavelets are Meyer wavelets.

The step of filtering is carried out by means of a discrete linear, causal filter having the following form:

$$s(t_i)=C\cdot X(t_i)+D\cdot h(t_i)$$

where:

$h(t_i)$ is the characteristic value of the swell at a measurement time $t_i$, $s(t_i)$ is the value of the output signal of the filter at the time of measurement $t_i$, $X(t_i)$ is a causal matrix function having the form $X(t_{i+1})=A\cdot X(t_i)+B\cdot h(t_i)$, where $X(t_0)=0$, and A, B, C, and D are constant matrices.

Following the step of calculating the time interval, the method includes a step of estimating a probability that the movement of the ship under the effects of the swell, when the lull detected affects the movement of the ship, is less than a predetermined movement threshold for a duration greater than a second predetermined time threshold, whereby the estimation is carried out, in particular, depending on the duration of the lull detected.

The characteristic value of the swell is selected from an elevation of the surface of the area of water at the measurement point, a speed of elevation of the surface of the area of water at the measurement point, or a water pressure at the measurement point.

BRIEF DESCRIPTION OF THE DRAWINGS

The invention will be better understood based on the following description, provided by way of example only, referring to the attached drawings, in which.

DETAILED DESCRIPTION

Figure 1:
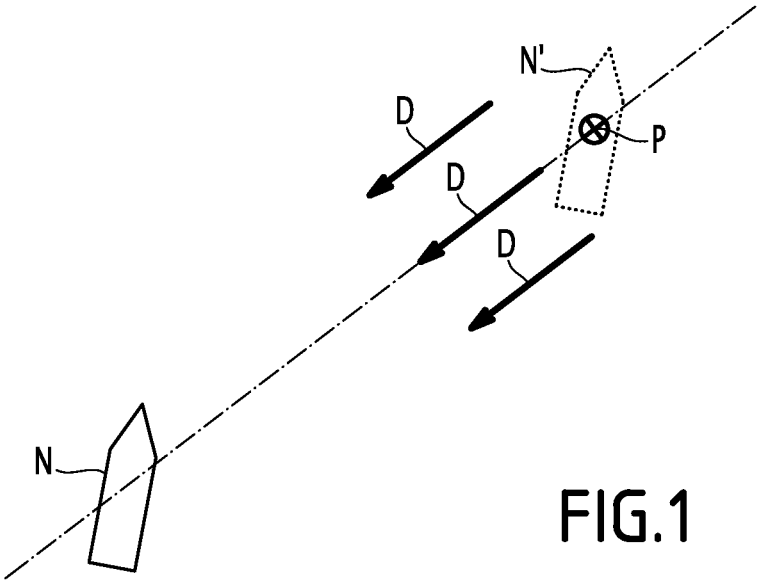
FIG. 1 shows a ship on an area of water.

FIG. 1 shows a ship N on an area of water on which at least one operation requiring the ship to be stable, such as deployment or recovery of a drone, is to be carried out.

In order to predict such a stability of the ship N, it is necessary to predict at least one movement of the ship N under the effect of the swell of the area of water, thus predicting the time at which this movement is slight.

The movement in question is selected from surge, sway, heave, rolling, pitch, or yaw of the ship N.

Figure 2:
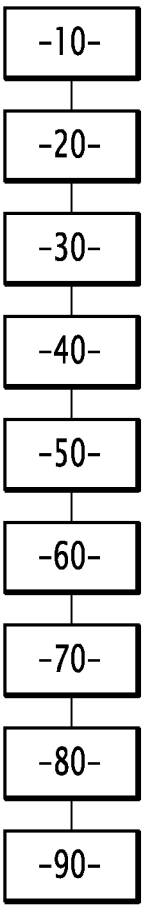
FIG. 2 shows the steps of the method according to the invention for predicting at least one movement of the ship of FIG. 1.

To this end, FIG. 2 shows the steps of a method for predicting at least one movement of the ship N under the effect of a swell on this area of water, according to one exemplary embodiment of the invention.

The method according to the invention includes a preliminary step 10 of estimating a direction D of propagation of the swell, and a step 20 of estimating a propagation speed of the swell in the direction of propagation D.

These estimation steps 10, 20 are carried out by means of means for estimating the direction and speed of propagation of the swell. Such means are known, and will thus not be described in detail. For example, these estimation means include a known RADAR-type monitoring system carried by the ship N, and/or adapted buoys arranged in the area of water to carry out measurements, suitable to communicate the measurements to the ship N.

These estimation steps 10, 20 may be carried out again at any time of the predicting method, in order, if necessary, to update the direction D and speed of propagation of the swell.

Once the direction D of propagation of the swell is known, the method includes a step 30 of measuring the development of a characteristic value of the swell at at least one measurement point P upstream of the ship N in the direction of propagation D, as shown in FIG. 1. The development of the value is measured by periodically measuring the value.

The value measured may be any characteristic value of the swell allowing for the instant energy of the swell to be obtained, e.g., the elevation of the free surface area, the elevation speed of this free surface area, or the pressure at a predetermined height. It should be noted that the measurement may be carried out at a point P or on a delimited space, e.g., a measurement grid.

These measures may be carried out by known means, e.g., a RADAR-, LIDAR-type, or other monitoring system carried by the ship N, and/or adapted buoys arranged in the area of water to carry out measurements, suitable to communicate the measurements to the ship N.

In the following, $h(t_i)$ is a measurement of the height carried out at a time $t_i=t_0+i\cdot dt$, where $t_0$ is the time of the first measurement, dt is the period in which the measurements are carried out, i.e., the sampling period, and i is the rank of the measurement in question.

All of the periodical measurements of the value form a discrete series representing the development of this characteristic value measured.

The method then includes a step 40 of filtering the development of the characteristic value measured by means of a discrete filter, the inputs of which are the measurements $h(t_i)$ of the characteristic value measured periodically, and the outputs of which represent the effect of the development of this characteristic value on the movement in question.

It should be noted that, if one wishes to study various movements of the ship, it is necessary to provide as many filters as movements under consideration in order to study the effects of the swell on each of the movements.

It should further be noted that, because the measurements are taken upstream of the ship, the outputs of the filter correspond to the notional movement under the effect of the swell of a notional ship (indicated by the reference N' on FIG. 1) having the same characteristics as the ship N, which would be located at the measurement point P. In the following, the signal formed by outputs of this filter will be referred to as 'notional upstream movement'.

In the following, the output of the filter at a time $t_i$ will be referred to as $s(t_i)$.

According to the embodiment described, the filter selected is a discrete linear, causal filter having the following form:

$$s(t_i)=C\cdot X(t_i)+D\cdot h(t_i), \text{ where}$$

X is a causal vector function such that: $X(t_{i+1})=A\cdot X(t_i)+B\cdot h(t_i)$ and:

$X(t_0)=0$, and

A, B, C, an D of the constant matrices.

The values of the constant matrices A, B, C, and D are determined experimentally, and are selected to minimise the deviation between the actual movements of the ship in response to the swell and the notional movements reconstructed by the filter. In particular, these values are a function of the characteristics of the ship, the speed of the ship, and the incidence of the swell relative to the heading of the ship, as well as the movement of the ship in question.

When the movement in question is rolling, the filter is, e.g., on the order of 4, i.e., a first filter on the order of 2 allowing for an approximation of the natural mechanical resonance of the ship, and a second cascading filter on the order of 2 allowing for an approximation of the excitation at the time of the rolling generated by the swell.

In order to study the upstream notional movement signal, the method includes a step 50 of calculating an envelope of the notional upstream movement signal. To this end, a Hilbert transformation H(s(t)) is applied to the output signal of the filter s(t), in order to obtain the imaginary portion of an analytical signal $S_{analytique}(t)$.

Thus:

$$H(s(t)) = \frac{1}{\pi}\int_{-\infty}^{+\infty} \frac{s(\tau)}{t-\tau}\, d\tau,$$

and $$S_{analytique}(t)=s(t)+i\cdot H(s(t))$$

The envelope of the signal s(t), noted as $S_{env}(t)$, is the norm of the analytical signal.

$$S_{env}(t)=|S_{analytique}(t)|$$

In the case of a discrete signal s(t), the envelope is calculated by the following algorithm:

a) the fast Fourier transformation of the signal S(f)=FFT(s(t)) is calculated;

b) a signal S'(f), defined as follows, is calculated:
   for positive frequencies f, S'(f)=2×S(f)
   for negative frequencies f, S'(f)=0,
   for null frequencies and the Shannon frequency, S'(f)=S(f).

c) the inverse transformation of the signal S'(f) is calculated, thus obtaining the envelope $S_{env}(t)$=IFFT(S'(f)).

Preferably, the Hilbert transformation is carried out on a sliding window applied to the output signal of the filter. Advantageously, the sliding window is selected to coincide between two null passes, i.e., s(t)=0 at the input and output of the filter. The signal is then extended by a mirror operation, ensuring the continuity of the periodic function and its derivative, thus mitigating the effects of the window. This mirror operation, which is known, consists of considering that the upstream or downstream signal, respectively, of the window is symmetric to the signal within the window relative to the point of the signal at the input or output of the window.

In fact, by applying a simple rectangular window without any upstream processing, artefacts (also known as edge effects) will appear on the edges of the signal. On the other hand, if the mirror operation is carried out before applying the Hilbert transformation in the window, the discontinuities will disappear.

Due to the envelope obtained, it will be possible to detect a lull in the swell relative to the movement in question, i.e., a lull in the swell that only causes a movement considered to be sufficiently slight. To this end, the method includes a step 60 of breaking down the envelope into wavelets, allowing for the isolation of the lowest frequency components of the envelope.

The number of components to take into consideration may be predetermined or established based on energy fractions. For example, Meyer wavelets may be used.

The method then includes a step 70 of detecting a lull in the swell at the measurement point P based on the wavelets obtained.

In the course of this detection step 70, the envelope is compared with a predetermined amplitude threshold.

This detection step 70 also provides a measurement of a duration of a lull, i.e., a duration in which this envelope is less than the predetermined amplitude threshold.

A lull is considered to have been detected if the measured duration of the lull is greater than a first predetermined time threshold.

If such a lull is detected, it may be considered to propagate in the direction of propagation D of the swell at the propagation speed of the swell, thus in the direction of the ship N.

The method thus includes a subsequent step 80 of calculating a time interval between the detection of the lull in the swell at the measurement point P and a moment in which the lull affects the movement of the ship N. This calculation is carried out, in particular, based on the speed of propagation of the swell that was previously estimated during the estimation step 20.

It should be noted that the calculation of the time interval also depends on the distance of the point P from the ship N. Thus, if one wishes to have a time interval sufficiently large to prepare the operation, a more distant point P may be selected.

If an operation of the ship requires it to be stable with respect to several movements, it is considered that this operation may be carried out when a lull is detected simultaneously for each of these movements.

It should be noted that it may happen that a lull does not propagate from the measurement point P to the ship N, in particular if the measurement point P is particularly distant from the ship N. Thus, following the step 80 of calculating the time interval, the method preferably includes a step 90 of calculating a probability that lull detected actually affects the movement of the ship, i.e., the movement of the ship under the effects of the swell is less than a predetermined movement threshold for a duration greater than a second predetermined time threshold.

This second predetermined time threshold corresponds to the minimum time necessary to carry out the operation.

This calculation is carried out, in particular, based on the duration of the lull detected. This probability estimation may be carried out by calculating formulae for the probability of detection and false alarms by means of the detection theory. In one variant, the estimation of the probability may be carried out by learning; this learning may occur, e.g., by counting, for a given number of lulls detected, how many of them propagate to the ship, in order to derivate a percentage from it.

The table below shows examples of probabilities obtained in tests of the method according to the invention.

In particular, a first time threshold (duration of a lull at the point P) of 50 seconds was taken into account, as well as a second time threshold (duration in which the movement of the ship is less than the predetermined movement threshold) of 40 seconds.

Thus, in the table below:

The first column specifies the distance of the point P from the ship N, in metres;

Each double column concerns an example of a specific movement, and includes

A column indicating the time interval measured between the lull at the point P and the lull at the ship N, in seconds A column indicating the probability of a lull of at least 40 seconds at the ship in the event of the detection of a lull of at least 50 seconds at the point P, in %.

The movements in question are heave, rolling, and pitch. In fact, a lull in these three movements is generally necessary for the deployment or recovery of a drone.

| | Heave | | Rolling | | Pitch | |
|---|---|---|---|---|---|---|
| Distance | Probability | Time | Probability | Time | Probability | Time |
| 480 m | 90% | 18 s | 98% | 13 s | 90% | 31 s |
| 720 m | 50% | 47 s | 90% | 40 s | 90% | 66 s |
| 960 m | 55% | 76 s | 90% | 67 s | 70% | 101 s |

It is clear that, the more distant the point P, the lower the probability of a lull at the ship, but the greater the time interval to prepare the operation. The distance of the ship from the point P will thus generally be selected according to the best balance between the need for a substantial interval to prepare the operation and the desire for a sufficient probability of a lull.

It should be noted that the invention is not limited to the embodiment described above, and could present various variants without exceeding the scope of the claims.

What is claimed is:

1. A method for executing a naval operation on a ship under the effect of a swell on an area of water, the swell comprising a peak and a lull, the method comprising:

estimating a direction of propagation of the swell, and estimating a propagation speed of the swell in the direction of propagation, measuring the development of a characteristic value of the swell at at least one measurement point upstream of the ship in the direction of propagation by periodically measuring the characteristic value, identifying the presence of the lull in the swell at the measuring point using a measurement of the development of the characteristic value, including a measurement of a duration of the lull, calculating a time interval between the detection of the lull in the swell at the measurement point and a moment in which the lull is expected to reach the ship and affect the movement of the ship based on the estimated propagation speed of the swell, and carrying out the naval operation at the end of time interval when the lull affects the movement of the ship.

2. The method according to claim 1, further comprising:

following the measuring, filtering the development of the characteristic value measured by means of a discrete filter, the inputs of which are the characteristic value periodically measured and the outputs of which are an output signal representing the effect of the development of the characteristic value on the movement in question of a notional ship identical to the ship and positioned at the measurement point, and calculating an envelope of the output signal of the filter.

3. The method according to claim 2, in which detecting a lull in the swell at the measurement point comprises:

comparing the envelope with a predetermined amplitude threshold, measuring the duration of the lull by measuring the duration in which the envelope is less than the amplitude threshold, whereby a lull is considered to have been detected if the measured duration of the lull is greater than a first predetermined time threshold.

4. The method according to claim 2, in which calculating of an envelope includes the application of a Hilbert transformation to the output signal of the filter.

5. The method according to claim 4, in which the Hilbert transformation is carried out on a sliding window applied to the output signal of the filter, whereby the sliding window is chosen to coincide between two 0 passes.

6. The method according to claim 2, including, following calculating of an envelope and before the detecting of a lull, a step of breaking down the envelope into wavelets.

7. The method according to claim 6, in which the wavelets are Meyer wavelets.

8. The method according to claim 2, in which the filtering is carried out through use of a discrete linear, causal filter having the following form:

$$s(t_i) = C \cdot X(t_i) + D \cdot h(t_i)$$

where:

$h(t_i)$ is the characteristic value of the swell at a measurement time $t_i$, $s(t_i)$ is the value of the output signal of the filter at the time of measurement $t_i$, $X(t_i)$ is a causal matrix function having the form $X(t_{i+1}) = A \cdot X(t_i) + B \cdot h(t_i)$, where $X(t_0) = 0$, and A, B, C, and D are constant matrices.

9. The method according to claim 1, including, following the calculating of the time interval, estimating a probability that the movement of the ship under the effects of the swell, when the lull detected affects the movement of the ship, is less than a predetermined movement threshold for a duration greater than a second predetermined time threshold, whereby the estimation is carried out, in particular, depending on the duration of the lull detected.

10. The prediction method according to claim 1, in which the characteristic value of the swell is selected from the group consisting of: an elevation of the surface of the area of water at the measurement point, a speed of elevation of the surface of the area of water at the measurement point, and a water pressure at the measurement point.

* * * * *